US008943977B2

(12) United States Patent
Goding

(10) Patent No.: US 8,943,977 B2
(45) Date of Patent: Feb. 3, 2015

(54) RAILWAY TRUCK HAVING VENTILATED BOLSTER ASSEMBLY

(71) Applicant: Electro-Motive Diesel, Inc., LaGrange, IL (US)

(72) Inventor: David J. Goding, Palos Park, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 119 days.

(21) Appl. No.: 13/665,930

(22) Filed: Oct. 31, 2012

(65) Prior Publication Data

US 2014/0116285 A1 May 1, 2014

(51) Int. Cl.
*B61C 5/02* (2006.01)

(52) U.S. Cl.
CPC ..... *B61C 5/02* (2013.01)
USPC ..... 105/59; 105/172

(58) Field of Classification Search
CPC ..... B61C 5/02
USPC ..... 105/59, 172, 414
See application file for complete search history.

(56) References Cited

U.S. PATENT DOCUMENTS

| | | | | | |
|---|---|---|---|---|---|
| 2,154,771 | A | * | 4/1939 | Piron | 105/59 |
| 2,164,444 | A | | 7/1939 | Blomberg | |
| 2,230,580 | A | * | 2/1941 | Adams et al. | 105/62.2 |
| 2,463,255 | A | * | 3/1949 | Elliott | 105/59 |
| 2,666,497 | A | * | 1/1954 | Weber | 454/84 |
| 2,719,487 | A | * | 10/1955 | Walsh | 105/35 |
| 3,116,700 | A | * | 1/1964 | Aydelott | 105/59 |
| 4,485,743 | A | | 12/1984 | Roush et al. | |
| 4,628,824 | A | | 12/1986 | Goding et al. | |
| 4,679,506 | A | | 7/1987 | Goding et al. | |
| 4,679,507 | A | | 7/1987 | Rassaian | |
| 4,765,250 | A | | 8/1988 | Goding | |
| 4,841,873 | A | | 6/1989 | Goding et al. | |
| 5,387,039 | A | * | 2/1995 | Bien | 384/477 |
| 5,613,444 | A | | 3/1997 | Ahmadian et al. | |
| 5,746,135 | A | | 5/1998 | Ahmadian et al. | |
| 6,871,598 | B2 | | 3/2005 | Schaller et al. | |
| 2005/0183625 | A1 | | 8/2005 | Goding et al. | |

OTHER PUBLICATIONS http://www.railroadforums.com/photos/data/589/1123_731_nova_granja_03jun2005.jpg (prior to Feb. 21, 2012), (1 page).
http://www.railpictures.net/images/d1/2/4/3/8243.1296750113.jpg (prior to Feb. 21, 2012), (1 page).

(Continued)

*Primary Examiner* — Zachary Kuhfuss
(74) *Attorney, Agent, or Firm* — Finnegan, Henderson, Farabow, Garrett & Dunner LLP

(57) ABSTRACT

A railway truck is disclosed for use with a locomotive. The railway truck may include a first axle, a second axle, a plurality of wheels connected to each of the first and second axles, a frame connecting the first and second axles, and a plurality of traction motors. The railway truck may also include a bolster assembly pivotally connected to the frame. The bolster assembly may include a hollow bolster having an inlet and a plurality of outlets in communication with the inlet. The plurality of outlets may generally correspond to the locations of each of the plurality of traction motors. The hollow bolster may also include a flexible bellow extending between each of the plurality of outlets and each of the plurality of traction motors.

18 Claims, 5 Drawing Sheets

(56) References Cited

OTHER PUBLICATIONS

"GE U50 Apparatus Location" and "GE U50 General Data," Information and diagram from "Operating Manual Model U50 Diesel-Electric Locomotive," Manual No. GEJ-3821, Sep. 1963, and "General Electric Locomotives: A Complete Line of Diesel-Electrics for America's Railroads," Form 15M, Sep. 1963 (1 page).
U.S. Appl. No. 13/409,100, entitled "Railway Truck Having Axle-Pinned Equalizer,", filed Feb. 29, 2012, (22 pages).
U.S. Appl. No. 13/409,101, entitled "Railway Truck Having Equalizer-Linked Frame," filed Feb. 29, 2012, (22 pages).
U.S. Appl. No. 13/409,079, entitled "Frame for Railway Truck,", filed Feb. 29, 2012, (22 pages).
U.S. Appl. No. 61/634,534, entitled "Railway Truck having Spring-Connected Equalizer and Frame," filed Feb. 29, 2012, (23 pages).
U.S. Appl. No. 13/409,102, entitled "Railway Truck having Spring-Connected Equalizer and Frame," filed Mar. 1, 2012, (23 pages).
U.S. Appl. No. 13/665,610, entitled "Railway Truck having Bolster-Suspended Traction Motor," filed Oct. 31, 2012, (20 pages).
U.S. Appl. No. 13/665,839, entitled "Railway Truck having Primary Traction Rod," filed Oct. 31, 2012, (20 pages).

* cited by examiner

RAILWAY TRUCK HAVING VENTILATED BOLSTER ASSEMBLY

TECHNICAL FIELD

The present disclosure relates generally to a railway truck and, more particularly, to a railway truck having a ventilated bolster assembly.

BACKGROUND

Locomotives traditionally include a car body that houses one or more power units of the locomotive. The weight of the car body is supported at either end by trucks that transfer the weight to opposing rails. The trucks typically include cast steel or fabricated frames that provide a mounting for traction motors, axles, and wheel sets. Each railway truck is configured to pivotally support a base platform of the car body by way of a common bolster. Locomotives can be equipped with trucks having two, three, or four axles.

The traction motors are typically coupled to each axle of the railway truck. During operation of the locomotive, the traction motors are generally powered by engines to drive the wheels by way of the axles. This activity can cause the traction motors to heat up. To function properly, the traction motors must be cooled to be protected from overheating. If the traction motors are not cooled properly and overheating occurs, the life expectancy, stability, and reliability of the traction motors can be reduced.

To prevent overheating, the traction motors are typically cooled using forced air from centrifugal fans mounted on the locomotive. One attempt to prevent overheating to the traction motors is disclosed in U.S. Pat. No. 2,164,444 that issued to Blomberg ("Blomberg") on Jul. 4, 1939. The fans blow air through passageways formed in the truck bolster and frame members leading to the traction motors. The air is then directed to the traction motors through flexible bellows that connect the frame to the lateral faces of the individual traction motors. The flexible bellows provide passageways for the air to reach the traction motors and also accommodate displacement that occurs as the frame and the traction motors move relative to each other during travel of the locomotive.

Although the cooling design disclosed in Blomberg may be functional in many situations, it may be less than optimal. This is because supplying air to the traction motors from the truck bolster requires forcing air through the frame members located between the truck bolster and the traction motors. Because the truck bolster, frame, and traction motors move with respect to each other, air may escape as it travels from the truck bolster through the frame and to the traction motors. The cooling design of Blomberg also requires air to be supplied to the traction motors at their lateral faces. This indirect route may cause difficulty in providing sufficient air to cool the traction motors.

The railway truck of the present disclosure solves one or more of the problems set forth above and/or other problems in the art.

SUMMARY

In one aspect, the present disclosure is related to a railway truck. The railway truck may include a first axle, a second axle, a plurality of wheels connected to each of the first and second axles, a frame connecting the first and second axles, and a plurality of traction motors. The railway truck may also include a bolster assembly pivotally connected to the frame. The bolster assembly may include a hollow bolster having an inlet and a plurality of outlets in communication with the inlet. The plurality of outlets may generally correspond to the locations of each of the plurality of traction motors. The hollow bolster may also include a flexible bellow extending between each of the plurality of outlets and each of the plurality of traction motors.

In another aspect, the present disclosure may be related to a method of cooling traction motors for a locomotive. The method may include pressurizing air and directing the pressurized air through a plenum chamber in a base platform of the locomotive into a hollow center of a span bolster. The method may also include distributing the pressurized air from the span bolster through a plurality of outlets to a plurality of traction motors.

DETAILED DESCRIPTION

Figure 1:
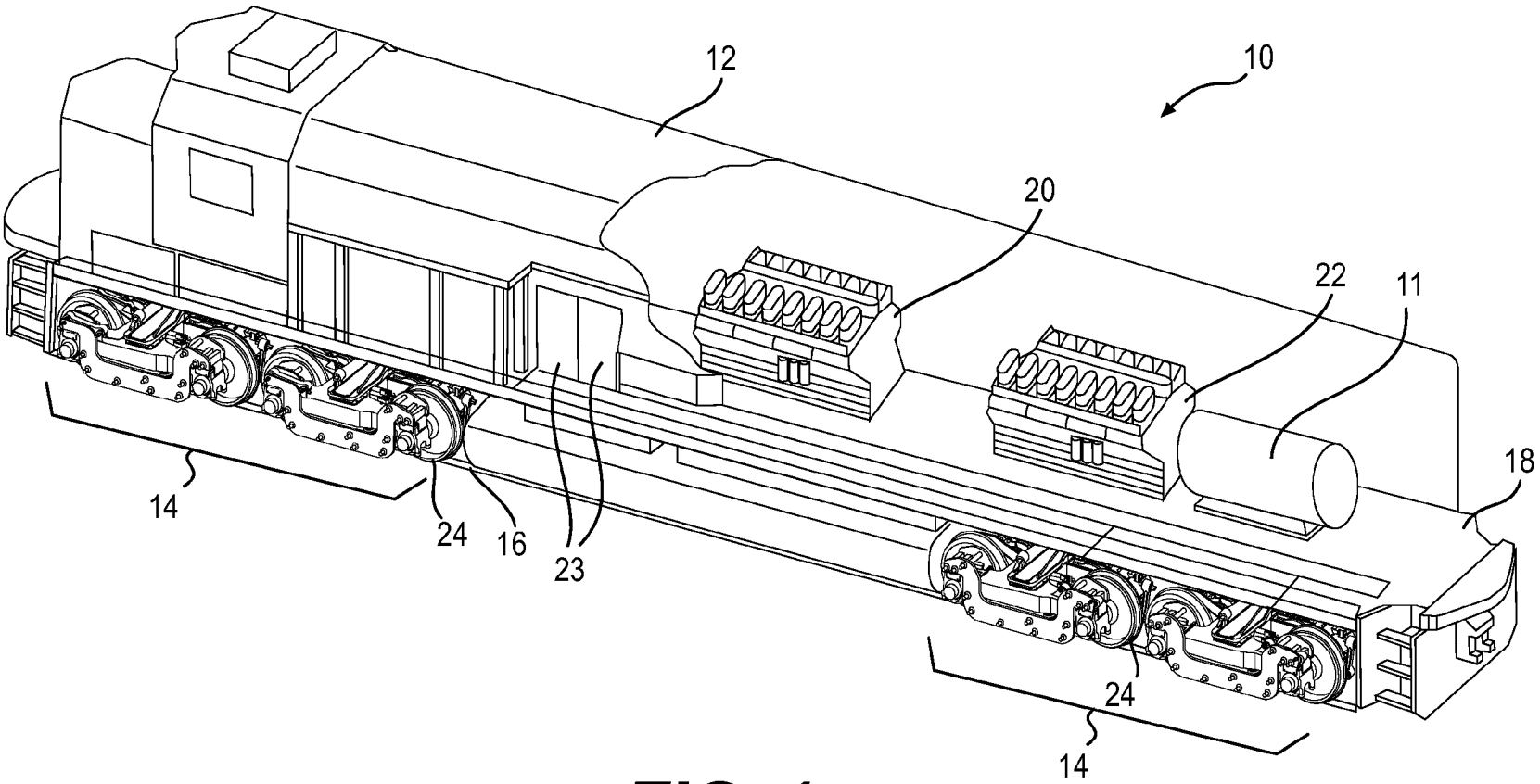
FIG. 1 is a pictorial illustration of an exemplary disclosed locomotive.

FIG. 1 illustrates an exemplary embodiment of a locomotive 10. Locomotive 10 may provide the motive power for a train and may include a car body 12 supported at opposing ends by a plurality of trucks 14 (e.g., two trucks 14). Each truck 14 may be oriented symmetrically about a center of locomotive 10. Trucks 14 may include a leading truck and a trailing truck. For the purposes of this disclosure, leading and trailing are defined with respect to a travel direction of trucks 14. Trucks 14 may be configured to engage a track 16 and support a base platform 18 of car body 12. Any number of engines may be mounted to base platform 18 and configured to drive a plurality of wheels 24 included within each truck 14. In the exemplary embodiment shown in FIG. 1, locomotive 10 includes a first engine 20 and a second engine 22 that are lengthwise aligned on base platform 18 in a travel direction of locomotive 10. One skilled in the art will recognize, however, that first and second engines 20, 22 may be arranged in tandem, transversally, or in any other orientation on base platform 18.

Car body 12 may be fixedly or removably connected to base platform 18 to substantially enclose first and second engines 20, 22, while still providing service access to first and second engines 20, 22. For example, car body 12 may be welded to base platform 18 and include one or more access doors 23 strategically located in the vicinity of first and second engines 20, 22. Alternatively, car body 12 may be attached to base platform 18 by way of fasteners such that portions or all of car body 12 may be completely removed from base platform 18 to provide the necessary access to first and second engines 20, 22. It is contemplated that car body 12 may alternatively be connected to base platform 18 in another manner, if desired.

Figure 2:
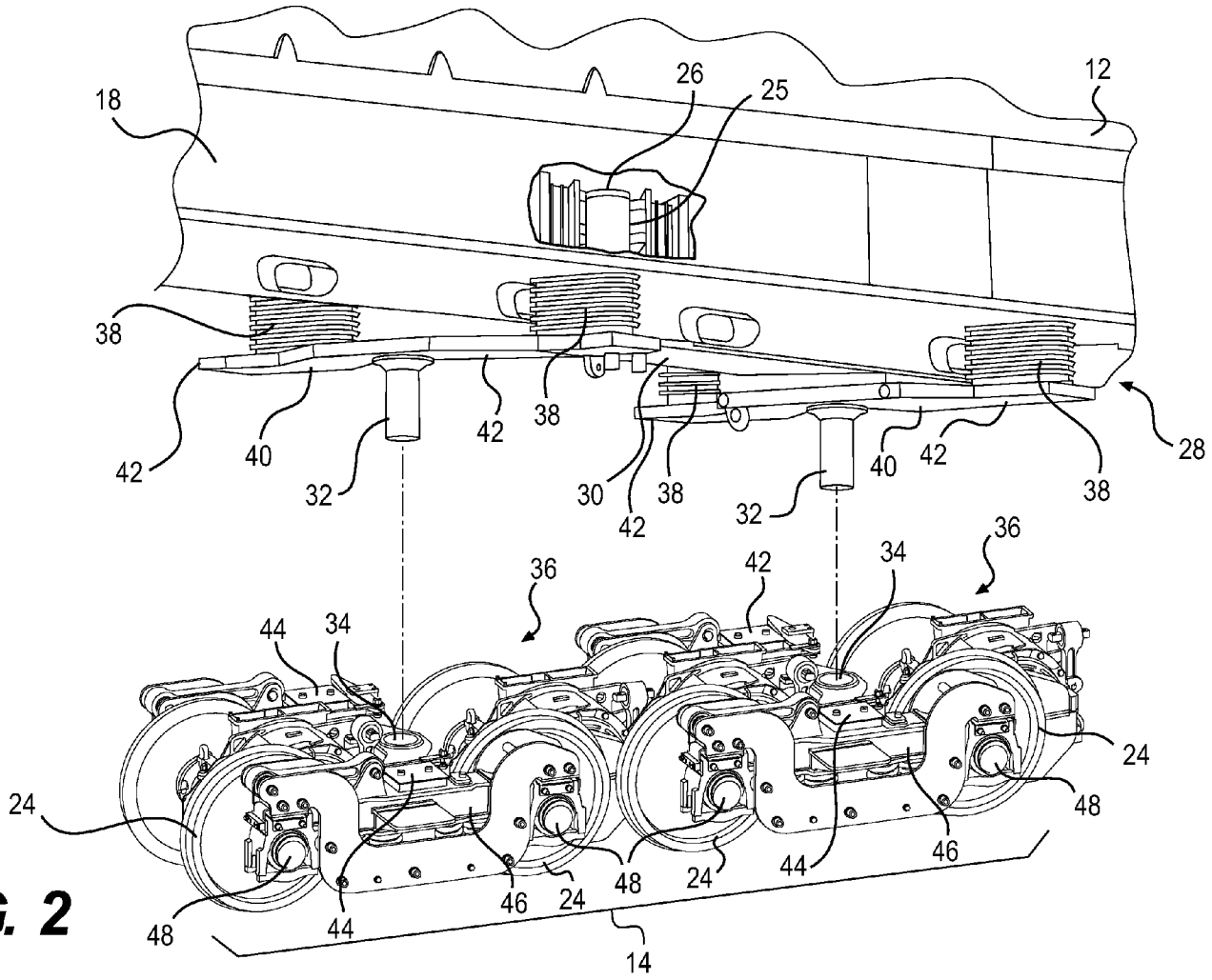
FIG. 2 is a semi-exploded diagrammatic illustration of an exemplary disclosed truck and bolster assembly that may be used in conjunction with the locomotive of FIG. 1.

Base platform 18 may be configured to pivot somewhat relative to trucks 14 during travel of locomotive 10 along a curving trajectory of tracks 16. As shown in FIG. 2, base platform 18 may be provided with a pivot shaft 25 at each end (only one end shown in FIG. 2) that extends downward from a transverse center to engage a pivot pin 26 within a bolster assembly 28. Pivot pin 26 may be lined with a low-wear material, for example nylon. Bolster assembly 28 may include a generally hollow beam (also known as a span bolster) 30 that is fixedly or flexibly connected to pivot pin 26 and extends in a lengthwise direction of base platform 18. In the disclosed embodiment, span bolster 30 is fixedly connected to pivot pin 26 by way of welding. Additional pivot shafts 32 may extend downward from opposing ends of span bolster 30 away from car body 12 to engage pivot housings 34 within separate sub-trucks 36 of each truck 14, thereby pivotally linking sub-trucks 36 together and to car body 12. In this configuration, car body 12 and sub-trucks 36 may all pivot independently relative to bolster assembly 28, allowing locomotive 10 to follow a curving trajectory of tracks 16. Pivot shaft 25 may be designed to transmit tractive forces (i.e., forces in a fore/aft direction, including propelling and braking forces) and lateral (i.e., side-to-side) forces between car body 12 and span bolster 30, with minimal transmission of vertical forces (i.e., weight of locomotive 10). Similarly, pivot shafts 32 may be designed to transmit these same tractive and lateral forces between span bolster 30 and sub-trucks 36, with minimal transmission of vertical forces.

Span bolster 30 may be spaced apart from base platform 18 by way of a plurality of resilient members (e.g., springs) 38 located in pairs in general fore/aft alignment with pivot shafts 32 at the sides of base platform 18. In particular, bolster assembly 28 may include transverse arms 40 located near the ends of span bolster 30 and rigidly connected to pivot shafts 32. Springs 38 may be sandwiched between distal tips 42 of arms 40 and an underside of base platform 18. In the disclosed embodiment, springs 38 may include rubber compression pads that are removably connected to arms 40 of span bolster 30 and pinned to base platform 18, although other configurations of springs 38 may also be utilized. Springs 38 may be configured to undergo a shearing motion during pivoting of base platform 18 relative to span bolster 30. Springs 38 may be configured to transmit vertical and lateral forces between car body 12 and span bolster 30, with minimal transmission of tractive forces.

Span bolster 30 may be similarly spaced apart from sub-trucks 36 by way of additional resilient members (e.g., springs) 44 located in pairs in general fore/aft alignment with pivot housings 34 at the sides of sub-trucks 36. In particular, springs 44 may be removably connected to a frame 46 of each sub-truck 36 and pinned to an underside of span bolster 30 (e.g., to an underside of arms 40) in the same manner that springs 38 are connected to arms 40 and pinned to car body 12. Similar to springs 38, springs 44 may be rubber compression pads that are configured to undergo a shearing motion during lateral displacement (i.e., pivoting) of sub-trucks 36 relative to span bolster 30. In this configuration, springs 44 may be configured to transmit vertical forces between sub-trucks 36 and span bolster 30, with minimal transmission of tractive or lateral forces.

Springs 44 may be located immediately below springs 38 to reduce stresses induced within span bolster 30 by vertical forces. In particular, vertical forces from frame 46 may pass through springs 44 and then through springs 38 into base platform 18, with reduced transmission of forces in transverse directions through span bolster 30. This configuration may help reduce distortion of span bolster 30 due to vertical force transmission.

Figure 3:
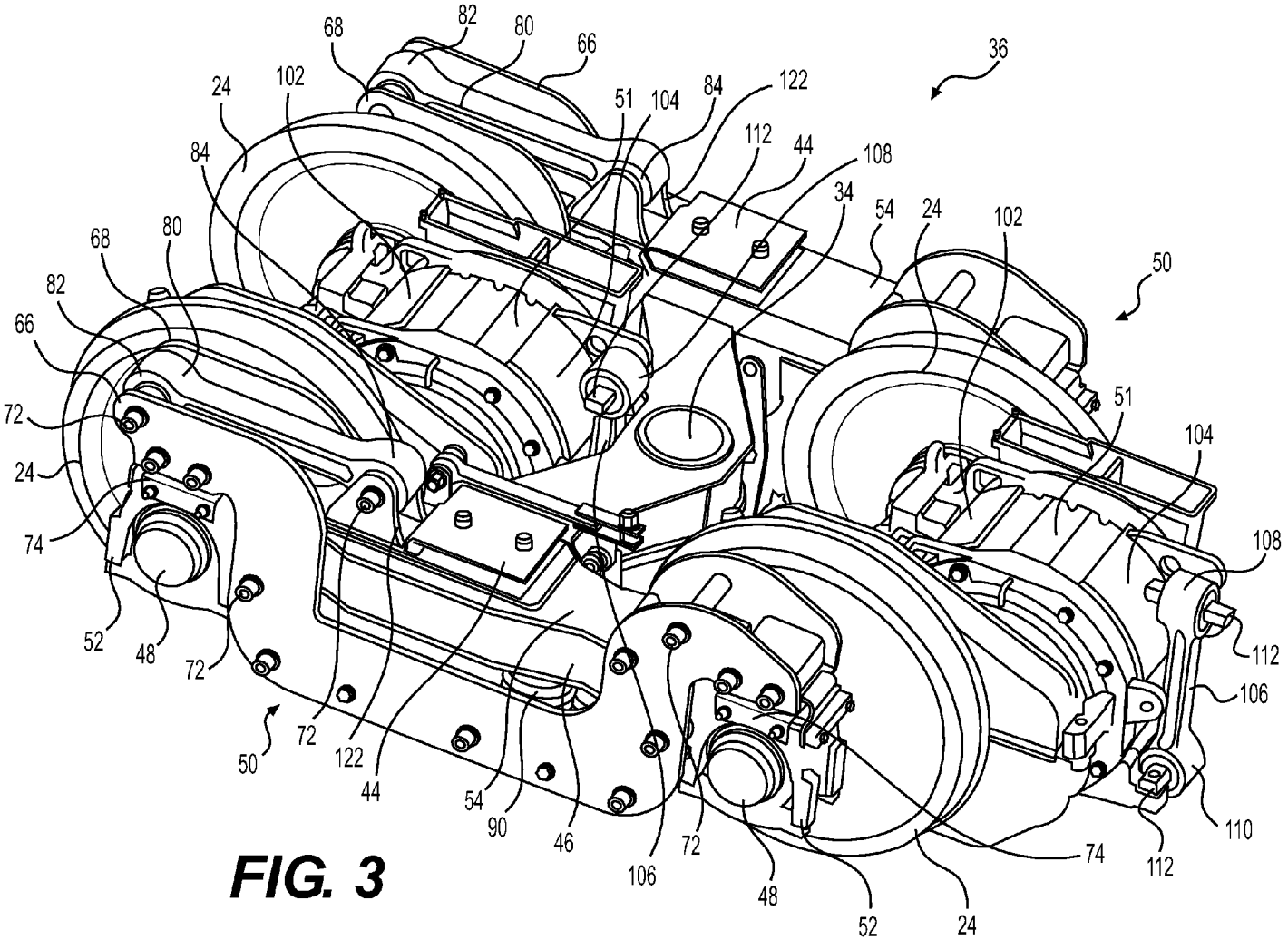
FIG. 3 is a pictorial illustration of an exemplary disclosed sub-truck that may be used in conjunction with the truck of FIG. 2.

An exemplary embodiment of one sub-truck 36 of truck 14 is shown in FIG. 3. It should be noted, however, that all sub-trucks 36 within locomotive 10 may be substantially identical. Each sub-truck 36 may be an assembly of components that together transfers lateral, tractive, and vertical forces between tracks 16 and car body 12. For example, each sub-truck 36 may include, among other things, wheels 24, a plurality of axles 48 connected between opposing wheels 24, frame 46, and an equalizer 50 located at each side of sub-truck 36 to connect wheels 24 with frame 46 and to help distribute vertical loads between axles 48.

Figure 4:
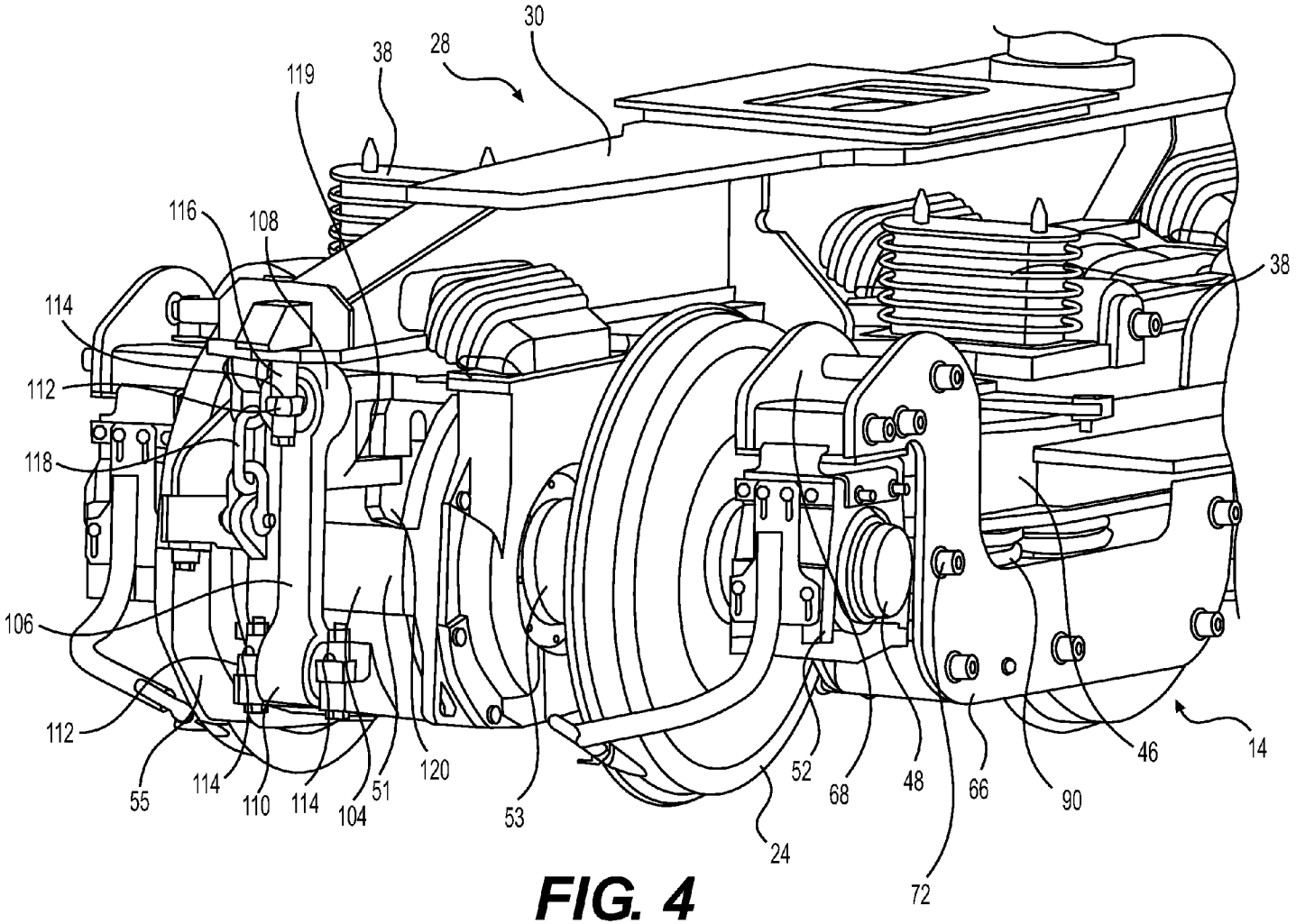
FIG. 4 is an enlarged pictorial illustration of a portion of the truck and bolster assembly of FIG. 2.

Two wheels 24 may be rigidly connected at the opposing ends of each axle 48 such that wheels 24 and axles 48 all rotate together. Axles 48 may include an inboard axle closer to a center of truck 14 and an outboard axle closer to an end of truck 14. A traction motor 51, for example an electric motor driven with power generated by first and second engines 20, 22 (referring to FIG. 1), may be disposed at a lengthwise center of each axle 48. Traction motor 51 may be configured to power wheels 24 via axles 48, thereby driving locomotive 10. The opposing ends of axles 48 may be held within separate bearing assemblies 52 such that forces (i.e., lateral, tractive, and vertical forces) may be transferred from wheels 24 through axles 48 and bearing assemblies 52 to the remaining components of sub-truck 36. Each traction motor 51 may be provided with an armature bearing 53 at a first axial end, as shown in FIG. 4. Armature bearing 53 may be tied to traction motor 51 and disposed along a general lengthwise center of axles 48 between wheels 24. A gear case 55 may be located on an opposite axial end of traction motor 51. Gear case 55 may be bolted to traction motor 51 via brackets and enclose mateable components such as a bull gear and pinion gear (not shown), which operate together to drive axles 48 and wheels 24.

Each traction motor 51 may include a first and second side 102, 104 disposed in general fore/aft alignment with the corresponding axle 48 (referring to FIG. 3). First side 102 of traction motor 51 may be vertically supported by support bearings of the associated axle 48, while second side 104 of traction motor 51 may be suspended from span bolster 30 by way of a torque reaction link 106. Torque reaction link 106 may be mounted in a generally vertical orientation, orthogonal to axle 48, at a general distance lengthwise from a center of each axle 48.

As shown in both FIGS. 3 and 4, torque reaction link 106 may be a rigid member and rounded first and second ends 108, 110. First and second ends 108, 110 may have a circular opening configured to receive a crosspiece 112. A rubber bushing may be disposed between crosspiece 112 and the circular opening of first and second ends 108, 110. First end 108 may be configured to pivot in a first direction and second end 110 may be configured to pivot in a second direction generally orthogonal to the first direction, although the rubber bushing may allow for rotation in all directions, including torsional and conical rotation. First end 108 may be configured to receive crosspiece 112 in a direction generally parallel to a lengthwise direction of span bolster 30 and a travel direction of locomotive 10, while second end 110 may be configured to receive crosspiece 112 in a direction generally parallel to axles 48. It is contemplated that first and second ends 108, 110 may alternatively be configured to receive crosspiece 112 in different directions, if desired.

Each crosspiece 112 may include bores 114 at opposing ends that are used to pivotally connect first and second ends 108, 110 of torque reaction link 106 to span bolster 30 and traction motor 51, respectively. First end 108 and bores 114 of crosspiece 112 may be configured to each receive a vertically-oriented tube 116 connected to a bottom of span bolster 30 by way of welding. Tube 116 may be configured to receive bolts threaded through bores 114 of crosspiece 112 to retain torque reaction link 106 connected to span bolster 30 at first end 108. In this manner, tubes 116 may help transfer torque reactions between traction motors 51 and span bolster 30, pivoting somewhat in a lateral direction. At second end 110, bores 114 of crosspiece 112 may be configured to receive bolts to pivotally secure torque reaction link 106 to second side 104 of traction motor 51. Torque reaction link 106 may be able to pivot in a fore/aft direction to permit the transfer of torque from span bolster 30 into axles 48.

Each traction motor 51 may be suspended from span bolster 30 by substantially identical torque reaction links 106 generally located equidistant from each other along a longitudinal length of span bolster 30. In the disclosed embodiment, truck 14 includes two traction motors 51 in each sub-truck 36 of each truck 14 (e.g., four motors total in the disclosed truck). Span bolster 30 may therefore be attached to four traction motors 51 spaced along the longitudinal length of span bolster 30. In the disclosed embodiment, one traction motor 51 of each sub-truck 36 may reside between axles 48 (e.g., associated with a leading axle of the associated sub-truck 36 of the leading railway truck and with a trailing axle of the associated sub-truck 36 of the trailing railway truck) and the other traction motor 51 may reside outside axles 48 (e.g., associated with a trailing axle of the associated sub-truck 36 of the leading railway truck and with a leading axle of the associated sub-truck 36 of the trailing railway truck). This arrangement may allow for axles 48 to be located closer together.

Span bolster 30 may include one or more safety features that help to prevent complete separation of traction motor 51 from span bolster 30 in the event of a loosening or failure of torque reaction link 106. For example, span bolster 30 may include a safety link 118 attached to second side 104 of traction motor 51 at a position adjacent to torque reaction link 106. Safety link 118 may be positioned generally parallel to torque reaction link 106 and bolted to a bottom side of span bolster 30 and second side 104 of traction motor 51. Safety link 118 may exhibit sufficient flexibility to avoid interference with the fore/aft pivoting of torque reaction link 106, while exhibiting sufficient strength to support traction motor 51 during a failure condition of torque reaction link 106. In this manner, safety link 118 may serve as a redundant connection vis-à-vis torque reaction link 106 by preventing traction motor 51 from engaging track 16 during a failure condition of torque reaction link 106.

It is contemplated that alternative safety brackets may be utilized, if desired. For example, span bolster 30 may include a safety hook 119 fabricated as a single piece in a general C-shape. Safety hook 119 may be positioned adjacent to and generally in parallel with torque reaction link 106, and configured to engage a corresponding bracket 120 attached to second side 104 of traction motor 51 at a position adjacent to torque reaction link 106. Bracket 120 may similarly be fabricated as a single piece in a general C-shape, and may slidingly engage safety hook 119 while still permitting vertical support. Like safety link 118, the interaction of safety hook 119 and bracket 120 may exhibit sufficient flexibility to avoid interference with torque reaction link 106, while also exhibiting sufficient strength to support traction motor 51 in the event of a failure of torque reaction link 106.

Frame 46 may be a fabrication of multiple components, including pivot housing 34 and substantially identical left and right arm members 54 that extend from pivot housing 34 in a lengthwise direction of sub-truck 36 to form a general H-shape (referring to FIG. 3). In this embodiment, pivot housing 34 may be an integral cast component having a center opening that is lined with a low-wear material, for example nylon, that is configured to receive pivot shaft 32 of bolster assembly 28 (referring to FIG. 2). Each of arm members 54 may be joined to opposing ends of pivot housing 34 by way of welding or mechanical fastening, as desired.

Equalizer 50 may be an assembly of components that together facilitate the transfer of forces between bearing assemblies 52 and frame 46 (referring to FIG. 3). In particular, equalizer 50 may include, among other things, an outer plate 66 and a substantially identical inner plate 68 that are held apart from each other by one or more spacers (not shown) and clamped together by one or more rivets 72 or other fasteners. Each of outer and inner plates 66, 68 of each equalizer 50 may be generally planar and fabricated as a single piece from flat stock in a general U-shape. The absence of welding between outer and inner plates 66, 68 of equalizer 50 may permit the use of high-strength materials that typically are inconvenient to weld. Opposing ends of equalizer 50 may rest atop front- and aft-located bearing assemblies 52 at each side of sub-truck 36, with wear pads 74 located between equalizers 50 and bearing assemblies 52. In this manner, vertical forces may be transferred between equalizers 50 and bearing assemblies 52 via wear pads 74.

Tractive forces may be transferred between equalizers 50 and frame 46 by way of two longitudinal traction links 80 on each side of sub-truck 36. Traction links 80 may be positioned between outer and inner plates 66, 68 at a lengthwise position associated with a leading axle 48 of sub-truck 36 of the leading railway truck and a trailing axle 48 of sub-truck 36 of the trailing railway truck. In particular, traction links 80 may be pivotally held in place between inner and outer plates 66, 68 of equalizer 50 at a first end 82 by one of rivets 72. First end 82 may be located generally above and slightly offset from (e.g., rearward of) the associated axle 48, and radially inward of an outer periphery of wheels 24. Traction links 80 may be pivotally connected at an opposing second end 84 to frame 46 via a bracket 122 similarly secured by one of rivets 72. Bracket 122 may be welded to a top side of arm members 54 of frame 46 and positioned adjacent to (e.g., rearward of) springs 44. In the disclosed embodiment, bracket 122 generally abuts springs 44. It is contemplated that traction links 80 may alternatively be fastened to equalizer 50 and frame 46 by other means, such as a threaded nut and bolt, if desired.

When frame 46 and equalizer 50 are in equilibrium (i.e., not moving significantly relative to each other), traction links 80 may be generally horizontal. However, during relative movement between frame 46 and equalizer 50, traction links 80 may pivot in the vertical direction somewhat. In this configuration, traction links 80 may constrain frame 46 relative to equalizers 50 in the tractive direction, yet still allow some relative movement in the vertical direction through pivoting of traction links 80. In some embodiments, a rubber bushing provided with an inner metal member (not shown) may be located within first and/or second ends 82, 84 of traction links 80 to receive rivet 72, if desired. The rubber bushing may allow for some roll and/or yaw of frame 46 relative to equalizer 50.

One or more spring supports (not shown) may also be disposed transversely between outer and inner plates 66, 68 at a lower portion of equalizer 50 to facilitate vertical dampening of frame movement relative to equalizer 50. Spring supports may embody plates that are held in a generally horizontal position by rivets 72, each support being configured to receive a corresponding spring 90. Springs 90 may be sandwiched between equalizer 50 and an underside of frame 46. In this configuration, vertical forces may be transferred between frame 46 and equalizer 50 by way of springs 90.

During operation of locomotive 10, engines 20, 22 may power traction motors 51 to propel locomotive 10 in a travel direction, which may involve the transfer of tractive, transverse, and vertical forces. As these forces are transferred between wheels 24 and car body 12 of locomotive 10, traction motors 51 may be subject to severe conditions, which may cause traction motors 51 to heat up and exhibit a vulnerability to overheating. The disclosed truck may be provided with a cooling circuit 123 used to mitigate overheating of traction motors 51.

Figure 5:
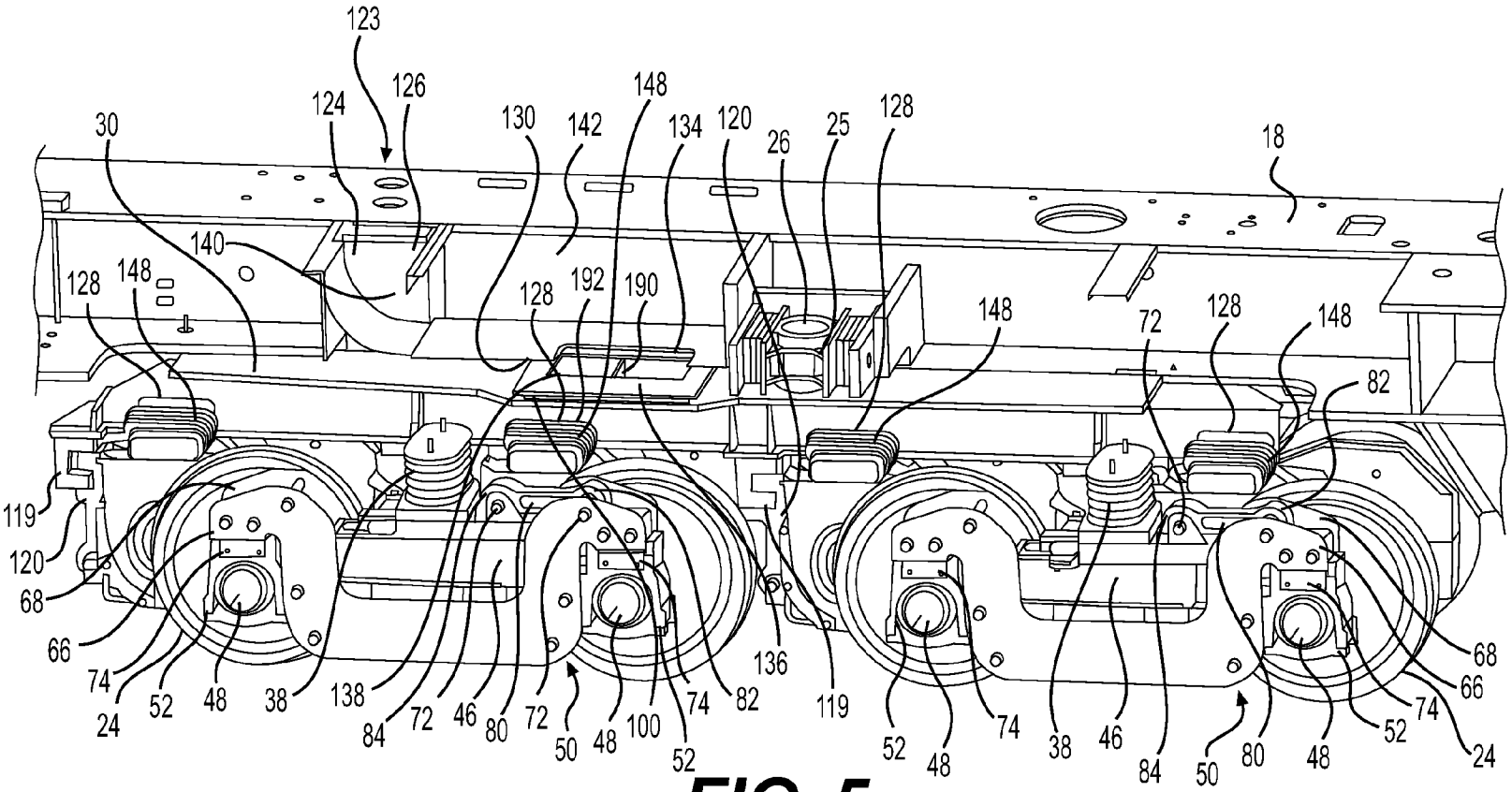
FIG. 5 is a cut-away illustration of the truck and bolster assembly of FIG. 2.

As shown in FIG. 5, cooling circuit 123 may include a plenum chamber 124 located within base platform 18 of car body 12. Plenum chamber 124 may receive pressurized air from an external source through an inlet 126 and direct the air through a trapezoidal outlet 134 into span bolster 30. In the disclosed embodiment, the external air source is a centrifugal blower 11 located within car body 12 and driven mechanically or electrically by one of engines 20, 22 (referring to FIG. 1). Plenum chamber 124 may extend from a top side of base platform 18 to a bottom side of base platform 18 in a vertical direction. Similarly, plenum chamber 124 may extend transversely from a first lateral side of base platform 18 to an opposite second lateral side of base platform 18. Longitudinally, plenum chamber 124 may extend along a length of base platform 18 from centrifugal blower 11 to a general center of span bolster 30. In the disclosed embodiment, plenum chamber 124 extends along approximately one-third the length of base platform 18.

Plenum chamber 124 may include curved and elongated passageways 140, 142. Pressurized air received by curved passageway 140 through inlet 126 may travel through elongated passageway 142 and funnel into outlet 134. A seal 100 may be formed at an interface 130 between span bolster 30 and base platform 18, around a general perimeter of outlet 134. Seal 100 may be positioned at a general lengthwise mid-portion of span bolster 30 adjacent to pivot pin 26 (only one half of base platform 18 along a longitudinal length shown in FIG. 5). It is contemplated that base platform 18 and span bolster 30 may alternatively share one or more seals at another position, if desired.

Span bolster 30 may include a rectangular inlet 138 in communication with outlet 134 via seal 100 at interface 130. A nylon pad 136 may be attached to a top side of span bolster 30, surrounding a perimeter of inlet 138. A foam rubber gasket may be applied to a bottom side of nylon pad 136 to provide the required strength to form seal 100. The overlap of outlet 134 and inlet 138 may provide a passageway to distribute air from base platform 18 into span bolster 30. Outlet 134 may, however, be significantly larger than inlet 138. In the disclosed embodiment, outlet 134 is approximately fifty percent larger than inlet 138. A size difference between outlet 134 and inlet 138 may help to assure proper communication between plenum chamber 124 and span bolster 30 during travel of locomotive 10 along a curving trajectory of tracks 16, which is described in greater detail below.

Span bolster 30 may be a hollow enclosure assembled, for example, by way of welding. Span bolster 30 may be wider at its midsection to facilitate its structural integrity. Equally spaced outlets 128 may be attached to span bolster 30 at positions generally corresponding to the locations of each traction motor 51. In the disclosed embodiment, span bolster 30 includes four outlets 128 at a single side of span bolster 30 that correspond to the locations of each traction motor 51. Additionally, in the disclosed embodiment, outlets 128 are located at a right side with respect to the view of an operator of locomotive 10. It is contemplated, however, that a different side may be used for different layouts of traction motors 51. A plurality of flexible bellows 148 may connect outlets 128 of span bolster 30 to traction motors 51. As sub-trucks 36 rotate relative to span bolster 30, displacements may occur between traction motors 51 and span bolster 30, which may result in flexible bellows 148 compressing and extending in a generally horizontal plane. This relative movement, however, may be significantly less than the movement between car body 12 and traction motors 51.

Span bolster 30 may include additional features to facilitate equal distribution of pressurized air to each traction motor 51. In particular, a divider plate 190 may be located within span bolster 30 at a general lengthwise center of inlet 138. Divider plate 190 may extend laterally between opposing sides of span bolster 30 and help divide the air from base platform 18 of car body 12 into two opposing flows. In this manner, divider plate 190 may direct generally equal amounts of air to each half of span bolster 30. By providing a structural connection between opposing sides of span bolster 30, divider plate 190 may also help facilitate the structural integrity of span bolster 30 at a location corresponding to inlet 138, which may be weaker due to the opening created by inlet 138. Divider plate 190 may be characterized by a thickness of approximately 0.5-2 inches and may be attached to span bolster 30, for example, by way of welding. In the disclosed embodiment, divider plate 190 is positioned perpendicularly to opposing sides of span bolster 30. It is contemplated, however, that divider plate 190 may be positioned at an angle to opposing sides of span bolster 30, if desired.

Additionally, to help prevent one traction motor 51 located near inlet 138 from receiving more air than another traction motor 51 located away from inlet 138, a generally flat orifice plate 192 may attach to an internal side of span bolster 30 along a longitudinal length of span bolster 30. In particular, orifice plate 192 may be located to correspond to outlet 128 such that orifice plate 192 surrounds a perimeter of outlet 128. In the disclosed embodiment, orifice plate 192 is attached to an internal side of span bolster 30 and surrounds a perimeter of outlet 128 at a single traction motor 51 located nearest inlet 138.

Industrial Applicability

The ventilation of traction motors 51 during operation of locomotive 10 will now be described. During operation of locomotive 10, engines 20, 22 may power traction motors 51. In particular, traction motors 51 may convert electrical energy into mechanical energy to exert torque on wheels 24 via axles 48, thereby driving wheels 24 and propelling locomotive 10 in a travel direction. This process may result in inefficiencies realized in the form of heat. In some situations, these inefficiencies may be significant result in overheating and cause malfunction and/or failure of traction motors 51, if not accounted for.

To help ensure proper functioning of traction motors 51 during operation of locomotive 10, the disclosed truck may be equipped with a cooling circuit 123. In particular, traction motors 51 may be cooled by air received from an external air source. In the disclosed embodiment, the external air source is a centrifugal blower 11 located within car body 18 that is driven by one of engines 20, 22 (referring to FIG. 1). The air pressurized by centrifugal blower 11 may be directed through inlet 126 and received by plenum chamber 124. The pressurized air may exit plenum chamber 124 via outlet 134 and enter span bolster 30 via inlet 138.

As the pressurized air disperses through inlet 138, divider plate 190 may help to equalize airflow to each traction motor 51 by directing generally equal amounts of pressurized air to each half of span bolster 30. The pressurized air may travel the length of span bolster 30 and disperse through outlets 128 generally corresponding to the position of traction motors 51. Orifice plate 192 may limit the pressurized air received by traction motor 51 located near inlet 138 from receiving more pressurized air than another traction motor 51 located away from inlet 138 by virtue of its location. Flexible bellows 148, connecting outlets 128 to traction motors 51, may compress and extend in a generally horizontal plane to help accommodate displacements between traction motors 51 and span bolster 30 as sub-trucks 36 rotate relative to span bolster 30. Pressurized air may enter traction motor 51 at a first axial end at armature bearing 53 and exit through openings (not shown) proximate to gear case 55. In this manner, traction motors 51 may be cooled.

It will be apparent to those skilled in the art that various modifications and variations can be made to the disclosed railway truck without departing from the scope of the disclosure. Other embodiments of the railway truck will be apparent to those skilled in the art from consideration of the specification and practice of the railway truck disclosed herein. It is intended that the specification and examples be considered as exemplary only, with a true scope of the disclosure being indicated by the following claims and their equivalents.

What is claimed is:

1. A railway truck, comprising:
- a first axle;
- a second axle;
- a plurality of wheels connected to each of the first and second axles;
- a frame connecting the first and second axles;
- a plurality of traction motors;
- a bolster assembly pivotally connected to the frame, wherein the bolster assembly includes:
  - a hollow bolster having an inlet and a plurality of outlets in communication with the inlet and generally corresponding to the locations of each of the plurality of traction motors; and
  - a flexible bellow extending between each of the plurality of outlets and each of the plurality of traction motors; and
- an internal divider plate extending between a first side and an opposing second side of the hollow bolster, wherein the internal divider plate is located at a general lengthwise center of the inlet.

2. The railway truck of claim 1, further including a base platform supported by the railway truck, wherein the base platform includes a plenum chamber configured to direct pressurized air into the hollow bolster via the inlet.

3. The railway truck of claim 2, further including an air source in communication with the plenum chamber.

4. The railway truck of claim 3, further including a seal formed at an interface of the hollow bolster and the base platform, the seal including a nylon pad attached to the hollow bolster.

5. The railway truck of claim 4, wherein the seal includes a foam rubber gasket between a bottom surface of the nylon pad and the top surface of the hollow bolster.

6. The railway truck of claim 2, wherein:
- the inlet is located at a top surface of the hollow bolster; and
- the base platform includes an outlet at a bottom surface in communication with the plenum chamber.

7. The railway truck of claim 6, wherein the inlet is rectangular and the outlet is trapezoidal.

8. The railway truck of claim 7, wherein:
- the inlet mates with the outlet; and
- the outlet is larger than the inlet.

9. The railway truck of claim 1, wherein the internal divider plate extends laterally between a first side and an opposing second side of the hollow bolster.

10. The railway truck of claim 1, wherein the plurality of outlets are positioned at generally equally spaced intervals at a single side of the hollow bolster.

11. The railway truck of claim 1, wherein the hollow bolster includes an internal orifice plate attached at a location corresponding to a first of the plurality of outlets.

12. The railway truck of claim 1, wherein the hollow bolster includes a midsection and opposing ends, and the midsection is wider than the ends.

13. A method of cooling traction motors for a locomotive, comprising:
- pressurizing air;
- directing the pressurized air through a plenum chamber in a base platform of the locomotive into a hollow center of a span bolster;
- distributing the pressurized air from the span bolster through a plurality of outlets to a plurality of traction motors; and
- dividing the pressurized air from the base platform into two opposing flows inside the span bolster.

14. The method of claim 13, wherein directing the pressurized air through the plenum chamber in the base platform of the locomotive to the span bolster includes directing through a single opening into the span bolster.

15. The method of claim 14, wherein distributing the pressurized air from the span bolster through the plurality of outlets includes distributing the pressurized air to the plurality of traction motors from only a single side of the span bolster.

16. The method of claim 14, further including restricting flow of the pressurized air within the span bolster at a location of an orifice plate corresponding to a first of the plurality of outlets.

17. The method of claim 16, further including directing the pressurized air axially through the plurality of traction motors to exits at a side of the span bolster opposite the plurality of outlets.

18. A locomotive, comprising:
- a car body having a base platform configured to support an air source and a plenum chamber formed in the base platform in communication with the air source; and
- a truck having a first sub-truck and a second sub-truck pivotally connected to opposing ends of a bolster assembly,
- wherein each of the first and second sub-trucks includes:
  - a first axle;
  - a second axle;
  - a plurality of wheels connected to each of the first and second axles;
  - a frame connecting the first and second axles;
  - a plurality of traction motors; and
- a hollow bolster having an inlet in communication with the plenum chamber and a plurality of outlets generally corresponding to a location of each of the plurality of traction motors, the hollow bolster having an internal divider plate located at a general lengthwise center of the inlet, and wherein each of the plurality of outlets includes a flexible bellow extending between the hollow bolster and each of the plurality of traction motors.

* * * * *